United States Patent [19]

Ingemann et al.

[11] 4,238,865

[45] Dec. 16, 1980

[54] BOOT SUPPORT DEVICE

[76] Inventors: Bertil Ingemann, Kristinelund, 235 00 Vellinge; Bertil Persson, Kerstis Vag 12 Hjarup, 222 48 Lund, both of Sweden

[21] Appl. No.: 27,119

[22] Filed: Apr. 4, 1979

Related U.S. Application Data

[63] Continuation-in-part of Ser. No. 788,970, Apr. 19, 1977, abandoned.

[30] Foreign Application Priority Data

Apr. 21, 1976 [SE] Sweden ..... 7604559

[51] Int. Cl.[2] ..... A43D 5/00; A44B 21/00; A47F 7/08

[52] U.S. Cl. ..... 12/114.8; 24/260; 211/34

[58] Field of Search ..... 12/114.6, 114.8; 24/84 C, 260, 251; 211/34, 38

[56] References Cited

U.S. PATENT DOCUMENTS

| | | | |
|---|---|---|---|
| 3,683,459 | 8/1972 | Johansen | 24/260 |
| 3,907,115 | 9/1975 | Satchell | 211/34 |

*Primary Examiner*—Patrick D. Lawson

*Attorney, Agent, or Firm*—Schwartz, Jeffery, Schwaab, Mack, Blumenthal & Koch

[57] ABSTRACT

A boot support device including a pair of shanks which engage each other intermediate their ends but closest to the upper end of the device. The inter-engagement of the shanks effects a rocking movement between the shanks to cause the lower ends of the shanks to move apart to facilitate insertion into the legs of boots. The divergence of the lower ends is effected by causing sections of the shanks near the upper ends to be squeezed together. A predetermined divergence may be effected by movement into a certain position of a hollow slider which is displaceable along the shanks. Divergence of the lower ends of the shanks may also be effected by manually squeezing together opposed sides of a loop-shaped connection extending between the shanks at the upper end.

22 Claims, 11 Drawing Figures

FIG. 2
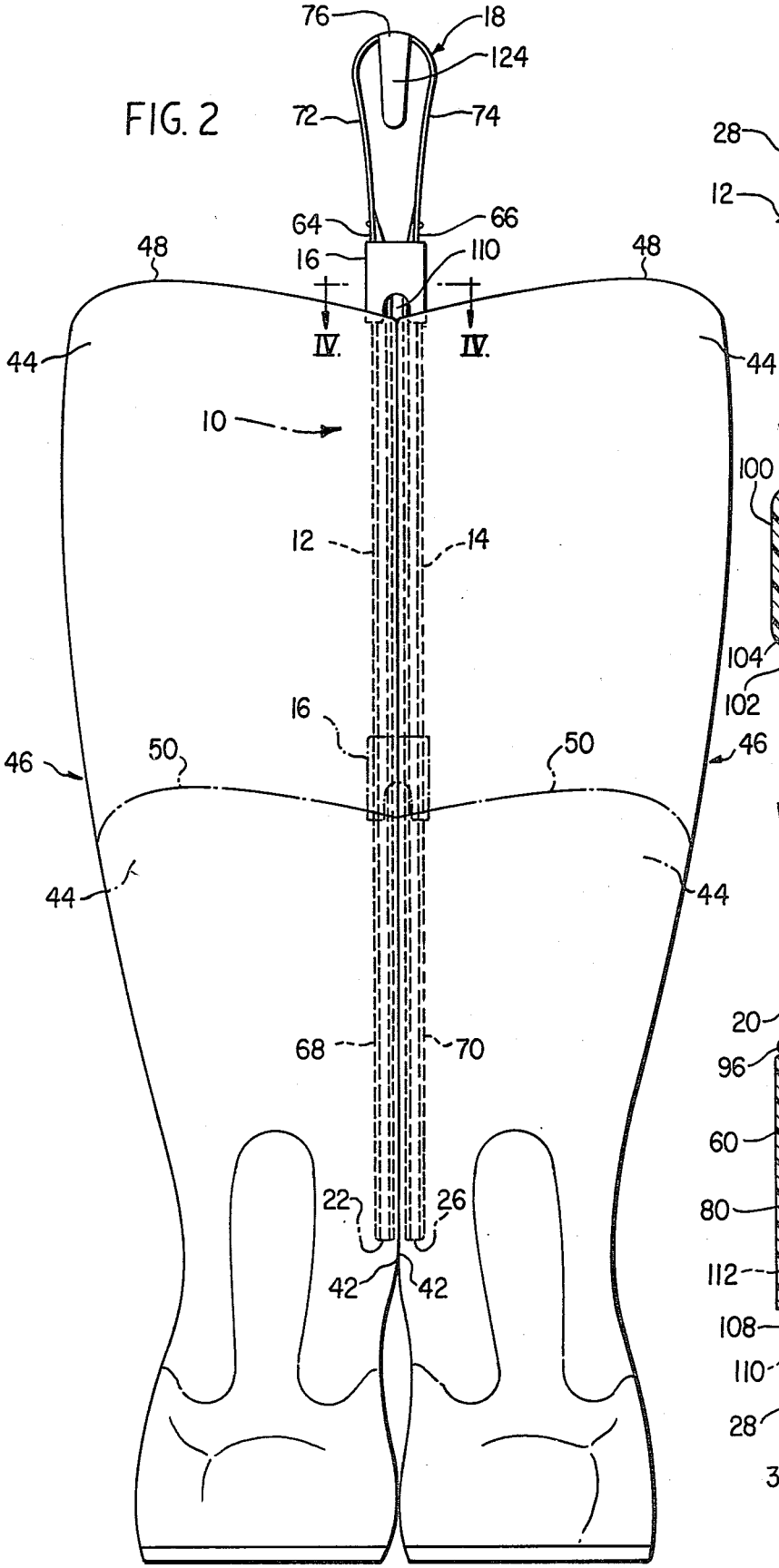
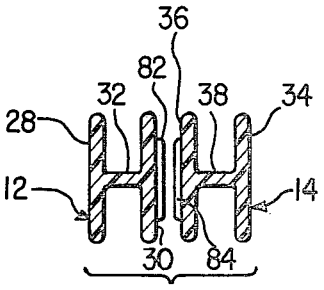
FIG. 3
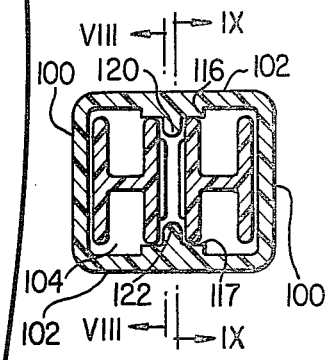
FIG. 4
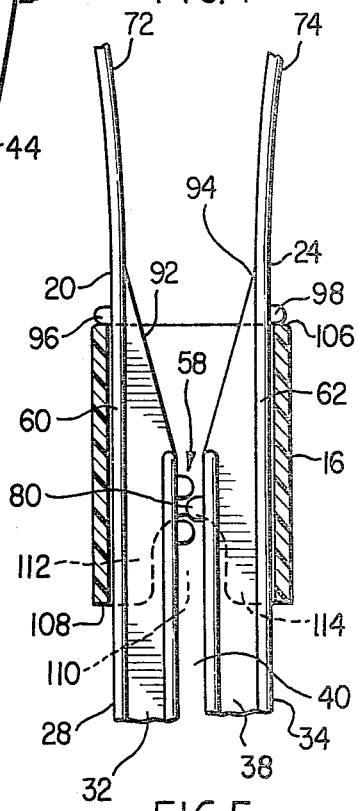
FIG. 5

BOOT SUPPORT DEVICE

CROSS REFERENCE TO RELATED APPLICATION

This is a continuation-in-part of co-pending application Ser. No. 788,970 filed Apr. 19, 1977 and now abandoned.

BACKGROUND OF THE INVENTION

1. Field of the Invention

The present invention relates to a device for supporting boots.

2. Prior Art

Boots, especially those made of leather or other soft material tend to collapse and/or tilt when they are stored after use. Thus, the boots tend to lose their shape, become unsightly, and become creased. When in this condition, they also tend to dry insufficiently and take up excessive space.

Attempts have previously been made to solve these problems, such as by a clamp securing the boots together at the tops of the boot legs. Such clamps, however, do not prevent the boots from collapsing.

Also, inflatable plastic pads or other devices for stretching the boots have been used. These, however, do not permit ventilation of the boots and they are generally rather unstable. Other mechanical devices have been used but they are often complex and difficult to handle as well as expensive and thus impractical.

U.S. Pat. No. 3,907,115 to Satchell discloses a boot support device intended to support the boot legs in an upright condition. In this device, however, the ability to hold the legs upright is at odds with the ease of inserting the device into the boots. The Satchell device provides a spring-like grip on the boot legs, and the stronger the grip, the more difficult it will be to insert the device into the boot legs.

OBJECTS OF THE INVENTION

It is an object of the present invention to overcome the drawbacks of prior art boot support devices as described above.

In this regard, it is a principal object of the present invention to provide a boot support device which, on the one hand, is very easily insertable into the legs of boots, and which, on the other hand, is capable of providing a tight grip on the legs of the boots to maintain the legs in an upright condition.

It is another object of the invention to provide a boot support device which prevents the boots from collapsing and/or tilting and which may be used for various sizes and types of boots.

It is yet another object of the invention to provide a boot support device which has a very simple construction, which is easy and inexpensive to manufacture, and which is efficient and easy to handle.

It is yet another object of the invention to provide a boot support device having a slidable clamping means in which movement of the clamping means into its upper position provides a predetermined spreading apart of the lower ends of the shanks of the boot support device to facilitate insertion into the legs of boots.

It is a related object of the invention to provide a boot support device having shanks which inter-engage each other at a point near the upper end to allow rocking of the shanks with respect to each other, such that squeezing together of upwardly diverging portions of the shank above the point of engagement effects divergence of the lower portions of the shanks to facilitate insertion into the legs of boots.

It is also a related object of the invention to provide a boot support device in which the moving together of the upper shank portions to effect divergence of the lower shank portions may be by means of the slider, or by manually squeezing together a connecting loop between the shanks, or both.

It is also an object of the present invention to provide a boot support device in which the lower ends will grip the insole of the boot to prevent sliding of the boot support device down an inclined insole.

These and other objects of the invention will be apparent from the detailed description which follows and from the drawing.

SUMMARY OF THE INVENTION

The present invention provides a boot support device for boots having upstanding legs with inside surfaces. The boot support device includes a pair of shanks having means for engaging the inside surfaces of the legs of the boots and for pressing the legs against each other. Each shank has a first and second end, the first ends of both shanks being disposed adjacent each other and the second ends of both shanks also being disposed adjacent each other. The device includes means for effecting a rocking movement between the shanks by engagement of the shanks with each other, the rocking means being disposed closer to the first ends of the shanks than the second ends, the shanks each including sections diverging from each other in a direction from the rocking means toward the first ends. The shanks include first portions, each first portion extending from the rocking means to the first end of one shank. The shanks also include second portions, each second portion extending from the rocking means to the second end of one shank. With this arrangement, pressure exerted on the diverging sections of the shanks urge the diverging sections together to effect rocking of the shanks with respect to each other about the rocking means. This, in turn, effects spreading apart of the second portions of the shanks to thereby facilitate insertion of the shanks into the legs of the boots.

The boot support device includes an end stop disposed adjacent the first ends of the shanks at a location spaced such a distance from the rocking means as to effect a predetermined squeezing movement of the diverging portions toward each other. This, in turn, effects a predetermined divergence of the second portions of the shanks to provide a suitable separation of the second portions of the shanks for insertion into the boots. The boot support device includes means, adjacent the first ends of the shanks and extending between the shanks, for connecting the shanks together. This connecting means includes means for effecting divergence of the second portions of the shanks in a direction toward the second ends thereof in response to manual deformation of the connecting means. Preferably, the shanks and the connecting means are all of one piece. Preferably, too, the connecting means includes a portion having the shape of an elongated loop with opposed sides facing each other and a crest between the opposed sides. The material of the connecting means is substantially thinner in cross-section and is substantially more flexible than the material of the shanks. The flexibility of the connecting means is such that the opposed sides of the loop of the connecting means may be easily manually squeezed together.

Each shank has an "H" shaped cross-sectional profile such that each shank includes a pair of parallel portions and a web portion extending transversely therebetween. The loop shaped portion of the connecting means has approximately the same thickness and cross-sectional profile as one of the two parallel portions of one of the shanks. The loop of the connecting means is coextensive with and of the same shape as the outwardly disposed parallel portions of the shanks.

The rocking means is at the inner portions of the shanks and includes means for preventing the shanks from sliding longitudinally with respect to each other during rocking movement and for restraining the rocking movement to an essentially pivotal movement. This preventing and restraining means includes a first protruding portion on the inside portion of one shank and a second protruding portion on the inside portion of the other shank, the second protruding portion including a recess therein for receiving the first protruding portion. The first and second protruding portions provide a fulcrum. The first protruding portion has the approximate shape of a half-cylinder and extends transversely across at least part of the inner portion of the shank. The second protruding portion includes two separate parts spaced apart, each having approximately the shape of a half-cylinder. The space between the two parts defines the recess.

The boot support device includes means for both clamping together the first shank portions and for also clamping together the second shank portions. Thus, the clamping means contributes both to effecting divergence of the second shank portions to facilitate insertion in the legs of boots and to bringing the second shank portions together to effect gripping of the legs of the boots. The clamping means preferably is a slider which surrounds both shank portions and is displaceable lengthwise therealong. The slider includes a first pair of walls parallel with the parallel portions of the shanks and a second pair of walls parallel to the web portions of the shanks. The first and second pairs of walls are joined together to define an opening in the slider through which the shanks extend. The slider has a first end facing the first ends of the shanks and a second end facing the second ends of the shanks. Each wall of the second pair of walls includes a recessed open area at the second end of the slider and extending toward the first end. The slider includes a pair of oppositely disposed bearing portions extending into the opening of the slider, the bearing portions engaging the inner portions of the shanks to provide sufficient friction between the slider and the shanks to both allow manual movement of the slider and yet to also maintain the slider in the position to which it has been moved. The slider also includes inwardly projecting guides on each wall of the second pair of walls in the regions of the bearings. The guides extend inwardly into the opening of the slider a greater distance than do the bearings. The guides are disposed in the region between the shanks to provide a predetermined separation of the shanks from each other for effecting clamping of the legs of the boots.

Both of the second portions of the shanks are preferably cambered concave inwardly with respect to the interior region between the shanks. The means for engaging the inside surfaces of the legs of the boots includes gripping means in the form of spaced projecting teeth on the inner portion of each shank. The projecting teeth of one shank are disposed in staggered relationship with respect to the projecting teeth of the other shank such that a tooth of one shank registers with the space between the two teeth of the other shank. Thus, the boot legs are clamped between a labyrinth-like structure. There is a hook on the connecting means, the hook and the crest portion of the connecting means having a tangential relationship with respect to each other. The hook is of one piece with the connecting means. There are a plurality of tooth-like projections at each of the second ends of the shanks. The tooth-like projections extend outwardly from the second end of each shank in the same direction as the lengthwise direction of each shank.

BRIEF DESCRIPTION OF THE DRAWINGS

FIG. 2 is an elevational view showing the boot support device in a clamped condition, the solid lines showing the boot support device supporting a pair of boots with relatively long leg portions and the phantom lines showing the boot support device supporting a pair of boots with relatively short leg portions.

FIG. 3 is a cross-sectional view taken on the line IV—IV of FIG. 2 through the shanks of the boot support device.

FIG. 4 is a cross-sectional view, also taken on the line IV—IV of FIG. 2 but also showing the slider surrounding the shanks.

FIG. 5 is a fragmentary view of a portion of the boot support device near the upper end showing the locking means and the slider pushed against the stops.

DETAILED DESCRIPTION OF THE PREFERRED EMBODIMENT

Figures 1, 6, 7:
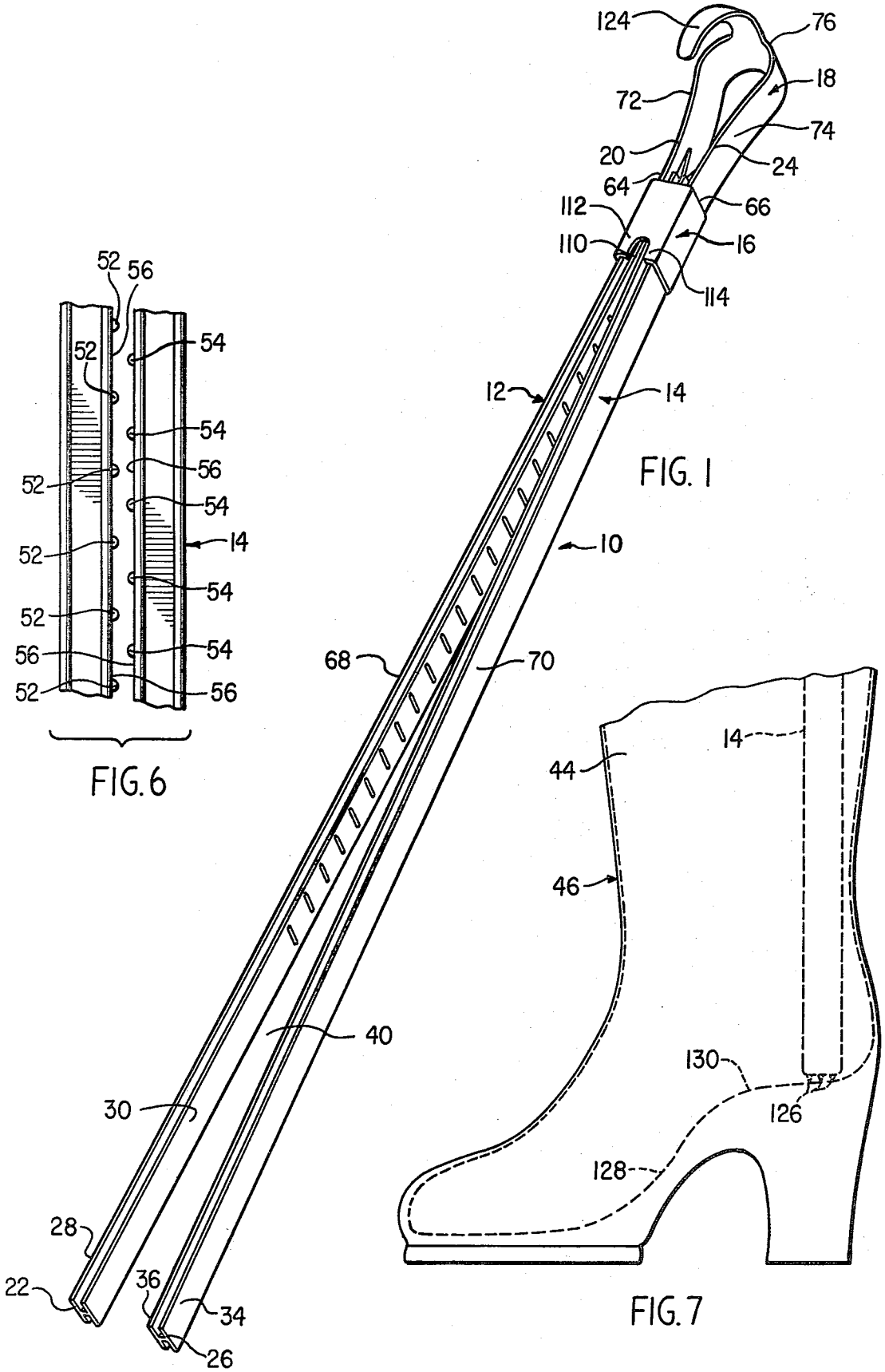
FIG. 1 is a perspective view of a boot support device according to the present invention.
FIG. 6 is a fragmentary elevational view of the shanks of the boot support device showing the staggered teeth thereof.
FIG. 7 is a fragmentary elevational view of a boot having a sloping insole and showing, in phantom lines, the lower portion of a boot support device according to the present invention with tooth-like projections at the lower ends of the shanks.

The boot support device is generally referred to by reference character 10. Boot support device 10 includes a pair of shanks 12, 14 and a clamping means in the form of a slider 16 which is displaceable along the shanks.

The shanks 12, 14 are of one piece with a connecting means 18 extending between the shanks. Shank 12 has an upper end 20 and a lower end 22. Likewise, shank 14 has an upper end 24 and a lower end 26.

As can best be seen in the perspective view of FIG. 1 and the cross-sectional view of FIG. 3, the shanks each have an "H" shaped cross-sectional profile such that each shank includes two parallel portions and a web portion extending transversely therebetween. In particular, shank 12 includes an outer parallel portion 28, an inner parallel portion 30, and a web 32 extending therebetween. Shank 14 includes an outer parallel portion 34, an inner parallel portion 36, and a web 38 extending therebetween. Shanks 12, 14 define an interior region 40 therebetween. Outer parallel portions 28 and 34 face outwardly with respect to interior region 40 and inner parallel portions 30, 36 face inwardly with respect to interior region 40.

As will be apparent from the drawings, upper ends 20, 24 of shanks 12, 14, respectively, are disposed adjacent each other and lower ends 22, 26 of shanks 12 and 14, respectively, are disposed adjacent each other.

Inner portions 30, 36 of shanks 12, 14, engage inside surfaces 42 of the legs 44 of a pair of boots 46 (FIG. 2) and press the legs 44 against each other as shown in FIG. 2. Clamping together of a pair of tall boots having relatively long legs 44 is shown in solid lines in FIG. 2. In this instance, the slider 16 will be moved to a position adjacent top edges 48 as also shown in solid lines in FIG. 2. The clamping device may also be used in connection with lower boots as shown in broken lines in FIG. 2. In that instance, the clamping means 16, as shown in broken lines, will be in a position substantially farther down than as shown in solid lines. Again, the clamping means or slider 16 will be adjacent the top edge 50 of the lower boots as shown in phantom lines. Of course, slider 16 can be brought no lower than the top edges (48 or 50) of the boots and the lower position of the slider 16 as shown in phantom lines in FIG. 2 is simply to illustrate the positioning of the slider in connection with a lower type of boot in which the top edge is represented by the phantom line 50.

To facilitate engagement of the shanks 12, 14, with the inside surfaces 42, of the boots 46, gripping means in the form of spaced projecting teeth 52, 54 are provided on the inner portions 30, 36 of shanks 12, 14, respectively. Projecting teeth 52 of shank 12 are disposed in staggered relationship with respect to projecting teeth 54 of shank 14. That is, a tooth 52 of shank 12 registers with the space 56 between two teeth 54 of shank 14, and vice versa (see FIG. 6. Thus, the boot legs 44 are clamped between a labyrinth-like structure.

The boot support device 10 is constructed so that lower ends 22, 26 of shanks 12, 14 may be easily moved into and maintained in a spread-apart relationship to facilitate insertion of the boot support device 10 into the boots 46. What principally contributes to this is the ability of the shanks to rock or pivot with respect to each other about a given area or point. This is accomplished by rocking means 58 by which shanks 12, 14 engage each other, the rocking means being disposed closer to upper ends 20, 24 of the shanks 12, 14 than to the lower ends 22, 26. The shanks 12, 14 each include, respectively, sections 60, 62 diverging from each other in a direction from the rocking means 58 toward the upper ends 20, 24. The shanks 12, 14, include, respectively, upper portions 64, 66 extending from rocking means 58 to the upper ends 20, 24 of each shank 12, 14. Similarly, shanks 12, 14 include, respectively, lower portions 68, 70 extending from rocking means 58 to the lower ends 24, 26 of each of the shanks 12, 14. With this construction, inwardly exerted pressure (see FIG. 11) on the diverging sections 60, 62 of the shank urges diverging sections 60, 62 together to effect rocking of shanks 12, 14 with respect to each other about rocking means 58 to in turn effect spreading apart of the lower portions 68, 70 of the shanks. This, in turn, facilitates insertion of the shanks into legs 44 of boots 46.

Figure 11:
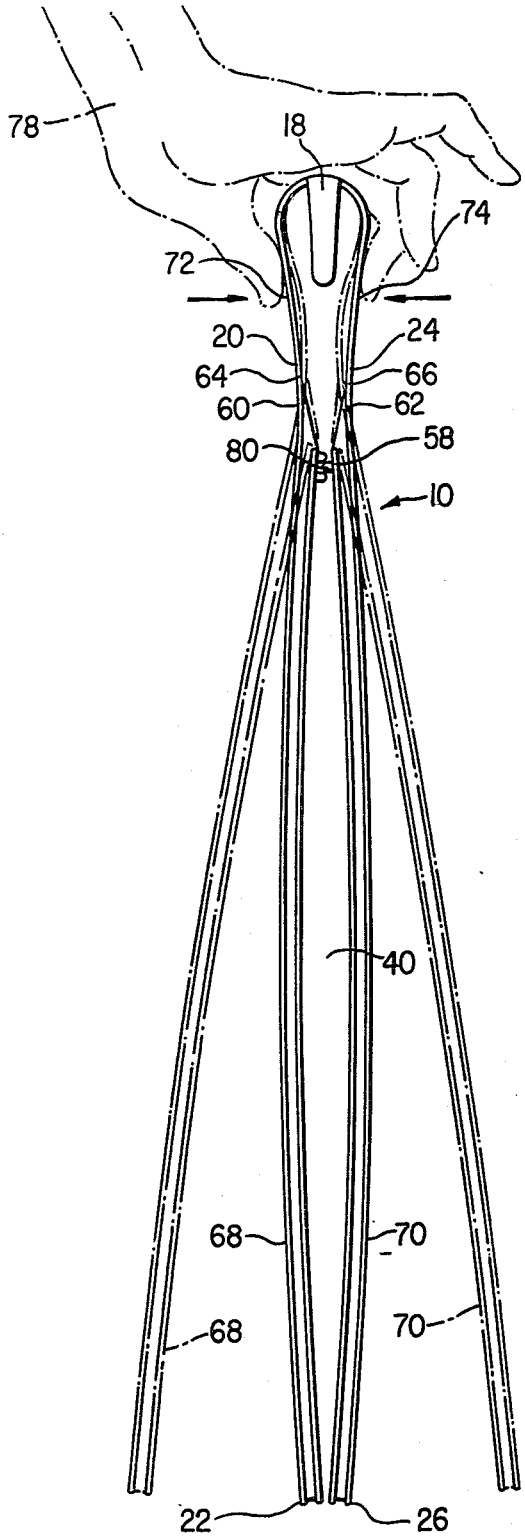
FIG. 11 is an elevational view of the boot support device with the slider removed for illustration purposes and showing in solid lines the camber of the shanks in a relaxed condition and showing in phantom lines the divergence of the shanks in response to an inward squeezing action at the upper shank portions or at the connecting means.
Figure 8:
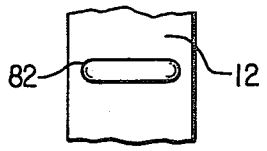
FIG. 8 is a fragmentary view taken on the line VIII—VIII of FIG. 4 and showing one portion of the rocking means.
Figure 9:
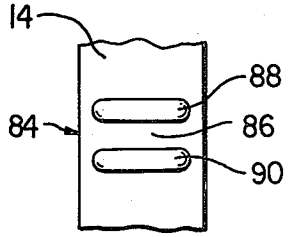
FIG. 9 is another fragmentary view taken on the line IX—IX of FIG. 4 and showing another portion of the rocking means.

Connecting means 18 adjacent the upper ends 20, 24 of the shanks 12, 14 includes a portion having the shape of an elongated loop with opposed sides 72, 74 facing each other and a crest portion 76 between sides 72, 74. Relative to the material of the shanks, the material of the connecting means is substantially thinner in cross-section (as will be apparent from the drawing) and is substantially more flexible. The flexibility is such that opposed sides 72, 74 of the loop of connecting means 18 may be easily manually squeezed together by the hand 78 of the user, as illustrated in FIG. 11. In FIG. 11, the broken line portion of the drawing indicates the squeezed together or compressed condition.

Figure 10:
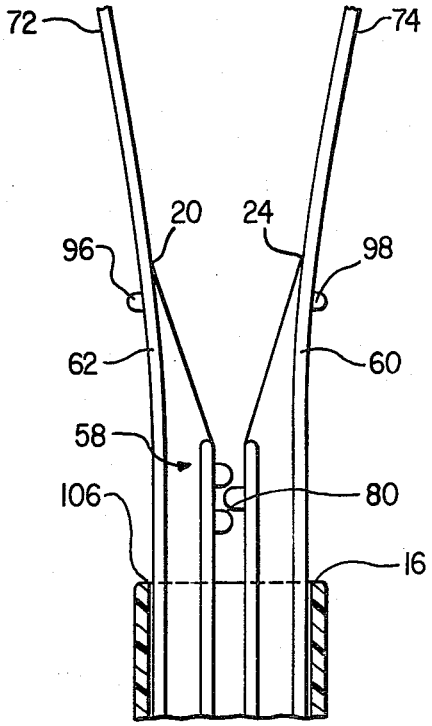
FIG. 10 is a fragmentary view, partially in section, similar to that of FIG. 5 showing an upper region of the boot support device and, in particular, illustrating divergence of an upper section of the shanks.

As will be appreciated from the drawing, particularly FIGS. 5, 10, and 11, the loop shaped portion of connecting means 18 has approximately the same thickness as outer parallel portions 28, 34 of shanks 12, 14. This loop shaped portion also has approximately the same cross-sectional profile as outer portions 28, 34. Indeed, the loop portion of the connecting means is coextensive with and of the same shape as outer shank portions 28, 34. Such configuration of the connecting means contributes to its flexibility. In this regard, the entire boot support device is preferably constructed of a flexible plastic material, the entire device except for the slider 16 preferably being of one piece. As indicated earlier, the flexibility of the loop shaped connecting means 18 is considerably greater than that of the shanks 12, 14 (which have the configuration of an "H" beam), in view of the relative gauges and configurations of these elements. The "H" shaped cross-section of the shanks 12, 14 gives the shanks maximum rigidity for a small wall thickness. While shanks 12, 14 are relatively rigid, they have enough, spring or flexibility to ensure a tight grip on the inside surfaces 42 of the boots 46.

The relative configurations of the shanks 12, 14 and slider 16 are such that slider 16 may be displaced along most of the length of the shanks 12, 14 without movement of the shanks relative to each other. Nevertheless, if slider 16 is displaced onto the upwardly diverging sections 60, 62 in the upper shank portions 64, 66, the slider 16 presses portions 60, 62 together in a manner similar to that shown in FIG. 11. This in turn effects a rocking motion of shanks 12, 14, about rocking means 58 such that the lower portions 68, 70 of the shanks are separated in order to facilitate insertion thereof into the boots 46.

By squeezing together the opposed sides 72, 74 of connecting means 18, the shanks 12, 14 may be further separated as shown in FIG. 11. Thus, the connecting means 18 contributes to effecting a downward divergence of the lower portions 68, 70 of the shanks in response to manual deformation of the connecting means 18.

In order to precisely control the separating of the lower portions 68, 70, rocking means 58 at the inner portions 30, 36 of shanks 12, 14 includes means 80 for preventing the shanks from sliding longitudinally with respect to each other during rocking movement and for restraining the rocking movement to an essentially pivotal movement. The preventing and restraining means includes a first protruding portion 82 on inner portion 30 of shank 12 and a second protruding portion 84 on the inner portion 36 of the shank 14. Second protruding portion 84 includes a recess 86 therein for receiving the first protruding portion 82. First and second protruding portions 82, 84 provide a fulcrum for the shanks 12, 14.

The first protruding portion has the approximate shape of a half-cylinder as may be appreciated from FIGS. 3, 4, 5, 8, 9, and 10. As will be seen in FIG. 8, the half-cylinder of first protruding portion 82 extends transversely across part of inner portion 30 of shank 12. As will be seen from FIG. 9, second protruding portion 84 includes two separate parts 88, 90 spaced apart. Each part 88, 90 also has approximately the shape of a half-cylinder. The space between the two parts 88, 90 defines recess 86.

It is noted that at least part of the upper portions 64, 66 of shanks 12, 14, have truncated inner portions 34, 36 and sloping portions 92, 94 of webs 32, 38. This allows gradual tapering into the loop-shaped connecting means 18. It is also to be noted that the preventing and restraining means 80 is located on stiff portions of shanks 12, 14, i.e. portions which include the full "H" cross-section. Nevertheless, preventing and restraining means 80 is located near the region where the shanks 12, 14, taper down to form the thin loop of the connecting means 18. This is best seen in FIGS. 5 and 10.

It will be apparent that preventing and restraining means 80 prevents the shanks 12, 14 from being displaced in parallel relationship with respect to each other in their longitudinal directions. Such displacement would tend to cause an unstable function upon insertion into the boots, i.e. the shanks might tend to become longitudinally staggered in view of the elasticity and flexibility of connecting means 18.

At the upper ends 20, 24 of shanks 12, 14, there are disposed a pair of end stops 96, 98. These end stops limit upward movement of the slider 16 to the point shown in FIG. 5 wherein slider 16 abuttingly engages end stops 96, 98. At this point, the slider will have compressed sections 60, 62 (which diverge upwardly in a relaxed condition) so as to effect spreading of lower portions 68, 70 of the shanks. End stops 96, 98 are placed at a precise location and spaced such a distance from the rocking means 58 as to effect a predetermined squeezing movement of the diverging portions toward each other to, in turn, effect a predetermined divergence of the lower portions 68, 70 of the shanks to provide a suitable separation of these lower portions for insertion into the boots 46. Note from FIG. 5 that in this position the major part of the slider is disposed just beyond the rocking means 58 in the upward direction. Of course, as discussed above, additional separation of lower portions 68, 70 of the shanks may be effected if necessary by manually squeezing together opposed sides 72, 74 of the loop shaped connecting means as shown in FIG. 11. Also, under certain conditions it may be possible to effect the desired separation of the lower portions 68, 70 by the manual squeezing action alone.

The boot support device 10 and particularly the slider 16 is so constructed as to obtain an especially positive clamping effect in boot legs of various thicknesses. As is apparent from the drawing and from the foregoing description, slider 16 surrounds both shank portions 12, 14 and is displaceable lengthwise therealong. Slider 16 includes a first pair of walls 100 parallel with the parallel portions 28, 30, 34, and 36 of the shanks. Slider 16 also includes a second pair of walls 102 parallel to web portions 32, 38 of the shanks. The first and second pairs of walls 100, 102 are joined together to define an opening 104 in the slider through which shanks 12, 14 extend. The slider has an upper end 106 facing the upper ends 20, 24 of shanks 12, 14 and a lower end 108 facing the lower ends 22, 26 of the shanks. Each wall of the second pair of walls 102 includes a recessed, open area 110 at lower end 108 of the slider and extending toward upper end 106 thereof.

Recessed area 110 helps to accommodate for variations in thickness of the legs 44 of boots 46. Slider 16 is constructed of elastic, flexible, plastic material and this, coupled with recessed open area 110 allows slider 16 to spring outwardly to various degrees depending on the thickness of the boot legs. In other words, the areas 112, 114 between recessed open area 110 can spread or deflect outwardly as need be. Thus, a soft and secure clamping with an elastic grip is obtained. The two aforementioned resilient areas or branches 112, 114 also allow the slider to grasp and hold the top edges 48 or 50 of the boots to aid in holding boot legs 44 of thick material.

Slider 16 includes a pair of oppositely disposed bearing portions 116, 118 extending into opening 104 of the slider. Bearing portions 116, 118 engage inner portions 30, 36 of shanks 12, 14 to provide sufficient friction between the slider and shanks to both allow manual movement of the slider and yet to also maintain the slider in the position to which it has been moved. In this regard, the distance between bearing portions 116, 118 is slightly less than the distance between the corresponding surfaces 30, 36 of the shanks when they are in their relaxed condition. This contributes to maintaining the proper frictional grip so that the slider 16 will not fall down when the boot support device 10 is suspended without boots. In order to obtain a suitable clamping effect with the slider 16 without at the same time requiring close production tolerances for the overall slider and shanks, the bearing portions 116, 118 are located only in the center portions of the second pair of slider walls 102. Thus, if the fit should happen to be too tight, the walls 102, being relatively flexible and relatively thin in comparison with the portion including bearing portions 116, 118, may bend outwardly without an excessively large force so as to prevent the clamping means from binding on the shanks.

Slider 16 includes a pair of inwardly projecting guides 120, 122 on each wall of the second pair of walls 102. Guides 120, 122 are disposed in the region of bearings 116, 118, and indeed are disposed centrally with respect to bearings 116, 118 and extend inwardly therefrom into slider opening 104 a greater distance than do the bearing portions 116, 118. When the slider is on the shanks 12, 14, guides 120, 122 are disposed in interior region 40 between the shanks to provide a predetermined separation of the shanks from each other for effective clamping of the legs of the boots. Also, guides 120, 122 contribute to guiding the slider 16 with respect to shanks 12, 14 during movement therealong.

Thus, it will be seen that the clamping means embodied by the slider 16 does not completely press the shanks together, but leaves a suitable distance therebetween. This enhances the clamping effect by accounting for the thickness of the boot legs 44. Also contributing in this regard is the camber of the shanks as shown in FIG. 11. That is, both the lower portions 68, 70 of shanks 12, 14 are cambered concave inwardly with respect to interior region 40 between the shanks. This camber also helps accommodate the thickness of the boot legs 44 and causes the shanks 12, 14 to resiliently grip the inside surfaces 42 of the boots when the slider 16 is moved into a clamping position adjacent the top edge 48 or 50 of the boots 46 as shown in FIG. 2. Of course, staggered teeth 52, 54 also contribute to this gripping and clamping effect as previously described.

It will be apparent from the foregoing and from the drawing that the clamping means embodied by the slider 16 both clamps together the upper portions 65, 66 of shanks 12, 14 and also clamps together the lower portions 68, 70 of the same shanks so that one clamping means contributes both to effecting divergence of the lower shank portions 68, 70 to facilitate insertion of the boot support device 10 into the legs of boots and also brings the lower shank portions 68, 70 together to effect gripping of the legs of the boots for boot storage.

To provide the capability not only for holding the legs 44 of boots 46 upright when the boots are stored on the floor but also to allow for suspension of the boots above a floor, a hook 124 is provided on the connecting means 118. Hook 124, as can be appreciated from the drawings, is of one piece with connecting means 118, and the hook 124 and crest portion 76 of the loop shaped connecting means have a tangential relationship with respect to each other. Hook 124 is of such configuration as to cooperate with, for example, another suspended hook or a rod of the type commonly found in closets or wardrobes.

Boot support device 10 may be constructed to avoid slippage of the device in a downward direction toward the toe of boots having a sloping insole. To accomplish this, lower ends 22, 26 of shanks 12, 14 may include a plurality of tooth-like projections 126 as shown in connection with shank 14 in FIG. 7. There, the sloping insole is designated by reference character 128. Tooth-like projections 126 extend downwardly and outwardly from lower ends 22, 26 of shanks 12, 14 in the same direction as the lengthwise direction of each shank 12, 14. Tooth-like projections 126 provide a positive grip when pressed against the inner heel area 130 of the boots during insertion of the shanks 12, 14 and even during later suspension of the boots 46 and boot support device 10.

While the present invention has been described in terms of a certain exemplary embodiment, it will be apparent that many modifications, changes or variations on the invention may be possible without departing from the spirit and scope thereof.

What is claimed is:

1. A boot support device for boots having upstanding legs with inside surfaces, the boot support device comprising:

(a) a pair of shanks;

(b) said shanks including means for engaging the inside surfaces of the legs of the boots and for pressing the legs against each other, each shank having a first and a second end, said first ends of both shanks being disposed adjacent each other and second ends of both shanks being disposed adjacent each other;

(c) means for effecting a rocking movement between said shanks by engagement of said shanks with each other, said rocking means being disposed closer to said first ends of said shanks than said second ends, said shanks each including sections diverging from each other in a direction from said rocking means toward said first ends, said shanks including first portions, each first portion extending from said rocking means to said first end of one shank, said shanks also including second portions, each second portion extending from said rocking means to said second end of one shank;

(d) whereby pressure exerted on said diverging sections of said shanks to urge said diverging sections together effects rocking of said shanks with respect to each other about said rocking means to in turn effect spreading apart of said second portions of said shanks to thereby facilitate insertion of said shanks into the legs of the boots.

2. A boot support device as defined in claim 1 including an end stop disposed adjacent said first ends of said shanks at a location spaced such a distance from said rocking means as to effect a predetermined squeezing movement of said diverging portions toward each other to, in turn, effect a predetermined divergence of said second portions of said shanks to provide a suitable separation of the second portions of said shanks for insertion into the boots.

3. A boot support device as defined in claim 1, including means, adjacent said first ends of said shanks, and extending between said shanks for connecting said shanks together.

4. A boot support device as defined in claim 3 wherein said connecting means includes means for effecting divergence of said second portions of said shanks in a direction toward said second ends thereof in response to manual deformation of said connecting means.

5. A boot support device as defined in claim 3 wherein said shanks and said connecting means are all of one piece.

6. A boot support device as defined in claim 3 wherein said connecting means includes a portion having the shape of an elongated loop with opposed sides facing each other.

7. A boot support device as defined in claim 6 wherein, relative to the material of said shanks, the material of said connecting means is substantially thinner in cross-section and is substantially more flexible, the flexibility being such that the opposed sides of the loop of the connecting means may be easily manually squeezed together.

8. A boot support device as defined in claim 6 wherein each shank includes two parallel portions and a web portion extending transversely therebetween.

9. A boot support device as defined in claim 8 wherein each shank has an "H" shaped cross-sectional profile.

10. A boot support device as defined in claim 8 wherein said loop shaped portion of said connecting means has approximately the same thickness and cross-sectional profile as one of said two parallel portions of one of said shanks.

11. A boot support device as defined in claim 8 wherein said shanks define an interior region therebetween, and wherein one of the two parallel portions of each shank is an outer portion facing outwardly with respect to said interior region, and wherein the other of the parallel portions is an inner portion facing inwardly with respect to said interior region, said loop portion of said connecting means being coextensive with and of the same shape as said outer parallel portions of both of said shanks.

12. A boot support device as defined in claim 11 wherein said rocking means is at said inner portions of said shanks and includes means for preventing said shanks from sliding longitudinally with respect to each other during rocking movement and for restraining said rocking movement to an essentially pivotal movement.

13. A boot support device as defined in claim 12 wherein said preventing and restraining means includes a first protruding portion on said inner portion of one shank and a second protruding portion on said inner portion of the other shank, said second protruding portion including a recess therein for receiving said first protruding portion, said first and second protruding portions providing a fulcrum.

14. A boot support device as defined in claim 13 wherein said first protruding portion has the approximate shape of a half-cylinder and extends transversely across at least part of said inner portion of said shank and wherein said second protruding portion includes two separate parts spaced apart, each part having approximately the shape of a half-cylinder, the space between the two parts defining said recess.

15. A boot support device as defined in claim 11 including means for both clamping together said first shank portions and for also clamping together said second shank portions and whereby the clamping means contributes both to effecting divergence of said second shank portions to facilitate insertion in the legs of boots and to bringing said second shank portions together to effect gripping of the legs of the boots.

16. A boot support device as defined in claim 15 wherein said clamping means is a slider which surrounds both shank portions and is displaceable lengthwise therealong.

17. A boot support device as defined in claim 16 wherein said slider includes a first pair of walls parallel with said parallel portions of said shanks and a second pair of walls parallel to said web portions of said shanks, said first and second pairs of walls being joined together to define an opening in said slider through which said shanks extend, said slider having a first end facing said first ends of said shanks and a second end facing said second ends of said shanks, each wall of said second pair of walls including a recessed, open area at said second end of said slider and extending toward said first end.

18. A boot support device as defined in claim 17 wherein said slider includes a pair of oppositely disposed bearing portions extending into said opening of said slider, said bearing portions engaging said inner portions of said shanks to provide sufficient friction between said slider and said shanks to both allow manual movement of said slider and yet to also maintain the slider in the position to which it has been moved.

19. A boot support device as defined in claim 18 wherein said slider includes inwardly projecting guides on each wall of said second pair of walls in the regions of said bearing portions, said guides extending inwardly into said opening of said slider a greater distance than do said bearing portions, said guides being disposed in said region between the shanks to provide a predetermined separation of said shanks from each other for ineffective clamping of the legs of the boots.

20. A boot support device as defined in claim 11 wherein both of said second portions of said shanks are cambered concave inwardly with respect to said interior region between the shanks.

21. A boot support device as defined in claim 11 wherein said means for engaging the inside surfaces of the legs of the boots includes gripping means in the form of spaced projecting teeth on said inner portion of each shank, said projecting teeth of one shank being disposed in staggered relationship with respect to the projecting teeth of the other shank such that a tooth of one shank registers with the space between two teeth of the other shank, whereby the boot legs are clamped between a labyrinth-like structure.

22. A boot support device as defined in claim 1 including a plurality of tooth-like projections at each of said second ends of said shanks, said tooth-like projections extending outwardly from said second and end of each shank in the same direction as the lengthwise direction of each shank.

* * * * *